United States Patent [19]

Steiner

[11] 4,407,336

[45] Oct. 4, 1983

[54] THREAD-FEED DEVICE FOR TEXTILE MACHINES AND METHOD OF OPERATION

[75] Inventor: Alois Steiner, Rieden, Switzerland

[73] Assignee: Ruti Machinery Works Ltd., Ruti, Switzerland

[21] Appl. No.: 274,217

[22] Filed: Jun. 16, 1981

[30] Foreign Application Priority Data

Jun. 17, 1980 [CH] Switzerland ..... 4642/80

[51] Int. Cl.[3] ..... B65H 47/01

[52] U.S. Cl. ..... 139/452; 242/47.1

[58] Field of Search ..... 139/452; 242/47.01, 242/47.12, 47.13; 66/132 R

[56] References Cited

U.S. PATENT DOCUMENTS 3,411,548 11/1968 Pfarrwaller ..... 139/152
3,761,031 9/1973 Pfarrwaller ..... 139/452
4,180,215 12/1979 Nurk ..... 242/47.01

FOREIGN PATENT DOCUMENTS 24561 3/1981 European Pat. Off. ..... 139/452
2920629 1/1980 Fed. Rep. of Germany ..... 139/152
565870 8/1977 U.S.S.R. ..... 139/452

*Primary Examiner*—Henry Jaudon
*Attorney, Agent, or Firm*—Donald D. Denton

[57] ABSTRACT

There is disclosed a thread-feed device having a stationary winder drum storing a supply of thread which can be wound-on by means of a rotatable winder arm and removed overhead from the winder drum, and having a first monitoring device which automatically controls the rotary movement of the winder arm as a function of the length of the supply of thread formed. Within the region of the withdrawal end of the winder drum there is arranged a second monitoring device which gives off a first signal to a control unit upon each pass of the thread through its monitoring region during the withdrawal of the thread. The control unit counts the first signals and, as soon as their number reaches a predetermined adjustable value which corresponds to the desired required length of thread, there is given off a second signal by which a thread gripper is actuated so that the thread-feed device delivers precisely measured lengths of thread, such as required for instance for the filling insertion on jet looms.

16 Claims, 1 Drawing Figure

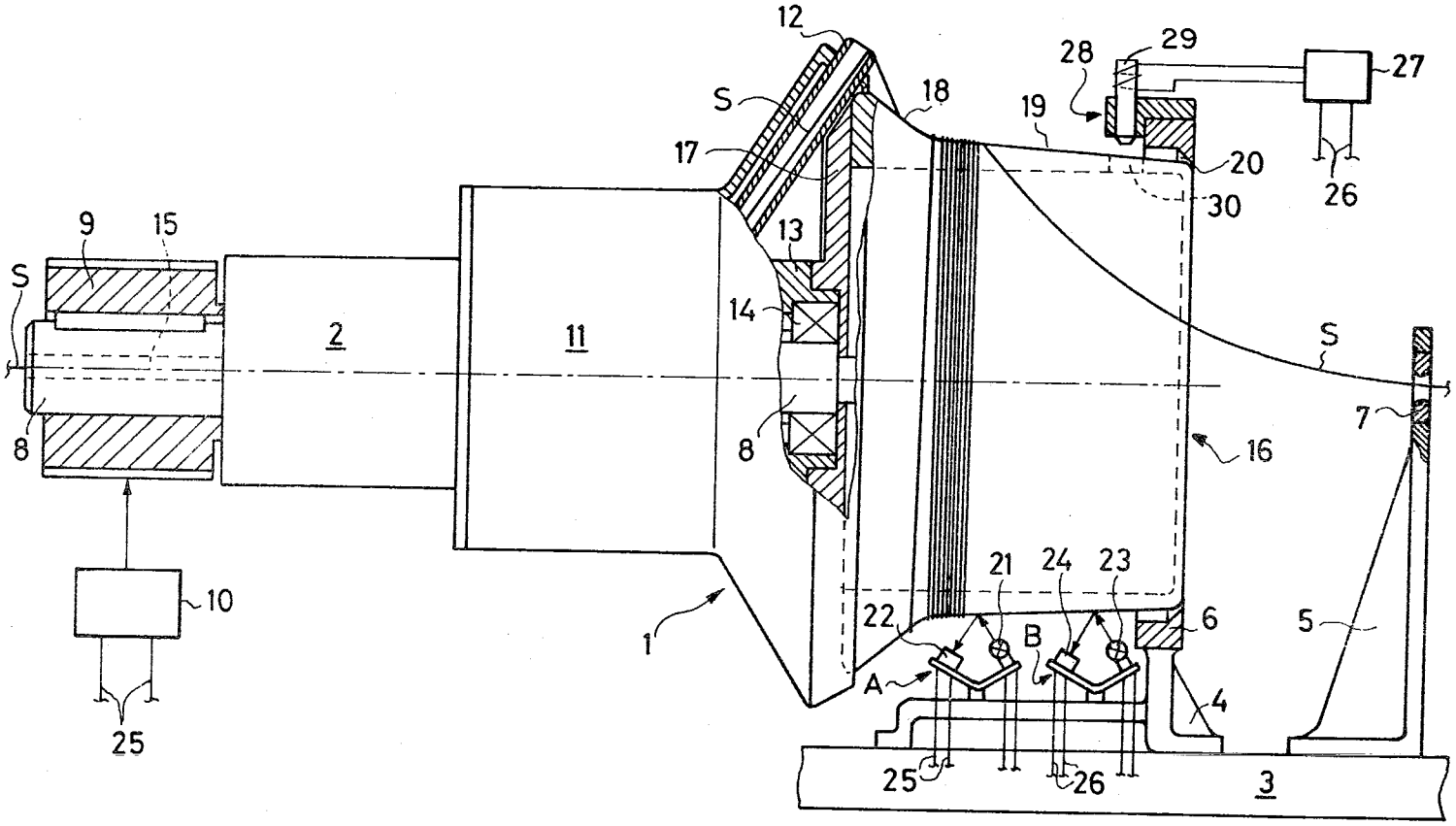
27
26
29
28
20
30
19
18
12
S
17
13
14
8
11
2
15
9
S
8
10
25
S
7
5
3
16
6
4
23
24
B
21
22
A
26
25
1

THREAD-FEED DEVICE FOR TEXTILE MACHINES AND METHOD OF OPERATION

BACKGROUND OF THE INVENTION

The present invention relates to a thread-feed device for textile machines having a stationary winder drum on which a thread fed from a stationary supply spool can be wound by means of a rotatable winder arm in order to form a supply of thread and the supply of thread formed can be withdrawn from above, and having a device for automatically controlling the rotary movement of the winder arm as a function of the length of the supply of thread formed.

Thread-feed devices of this type, which are known as forespooling devices, are known in many embodiments and are used both in knitting machines and in looms employing gripper and projectile type filling insertion devices. By the device for controlling the rotary movement of the winder arm a supply of thread sufficient for a filling insertion is always prepared on its winder drum. As soon as this supply of thread is withdrawn, thread is again placed on the winder drum by the winder arm.

For the requirements of the said looms in which the filling thread is introduced in positive fashion, the known forespooling devices serve their purpose since the insertion members which insert the filling thread in positive manner remove only just the required length of thread from the forespooling device so that said devices need merely store a sufficient length of thread.

The problem is entirely different in the case of jet looms in which the filling thread, as is known, is introduced in non-positive manner. In this case a thread-feed device must not only store a sufficient length of thread but, in addition, it must supply to the loom accurately measured lengths of thread at precisely determined times. Since the known forespooling devices do not satisfy these requirements, it has not been possible to use them heretofore on jet looms.

For jet looms there are known, on the one hand, thread-feed devices which have separate dimensioning and storage parts, the dimensioning part being formed by rotating rollers, reciprocating fingers, and the like, and the storage part by a pneumatic storage in which the thread is stored in the form of an elongated loop. On the other hand, there are known thread feed devices having a winder drum on which the filling thread is wound by a winder arm and is alternately blocked or released for the insertion of the filling thread by pins which periodically pass through the wall of the winder drum.

In the first-mentioned thread-feed devices, problems as to space arise, among other reasons, because of the fact that the length of storage increases with the weaving width. In the said second thread-feed device, precise synchronism must be present between filling insertion, movement of the winder arm, and movement of the pins.

These problems are multiplied as soon as different (for instance different colored) filling threads are to be inserted. In such case, as is known, a separate thread-feed device must be present for each color. In the case of the first-mentioned thread-feed devices, the space problems which in any event are present are, of course, increased. And the second said thread-feed devices can be used in this case only if the change of color takes place in a constant rhythm, in which case the speed of rotation of the individual units must be selected in proportion to this rhythm. As soon, however, as the color change is to be freely selectable, these thread-feed devices cannot be used because of the coupling between the movement of the winder arm and the pins, since as soon as and as long as a given filling thread is not required, the corresponding thread-feed device is stopped, but if the filling thread is required, then it must start up practically free of delay.

The closest prior art known to the inventor in connection with this application is U.S. Pat. No. 3,411,548, which is made a part of this application by way of reference.

SUMMARY OF THE INVENTION

The present invention solves the problem of providing a thread-feed device which can be used also for jet looms, which both requires only a small amount of space and is suitable also for multicolored filling insertion with free sequence of colors.

This object is achieved in accordance with the invention in the manner that a forespooling device of the aforementioned type has the following features:

a. a monitoring device arranged in the region of the withdrawal end of the winder drum for the giving off of a first signal upon each pass of the thread during its withdrawal through its monitoring region;

b. a control unit, arranged behind the monitoring device, for counting the first signals and giving off a second signal as soon as the number of first signals has reached a predetermined adjustable value which corresponds to the required length of thread, and c. a thread gripper which is connected to the control unit and can be controlled by the second signal.

Whenever a first signal is given off by the monitoring device, a length of thread corresponding to the circumference of the drum has just been withdrawn from the winder drum. By determining how many such lengths of thread corresponding to a drum circumference correspond to the filling-thread length to be inserted, the monitoring device affords a simple possibility of determining precisely the time at which the required length of thread has been withdrawn. This is effected in simple manner by counting the first signals. As soon as they reach the predetermined threshold value, the thread gripper is actuated via the second signal and assurance is had that the required length of thread has been delivered precisely to the loom.

The device for controlling the rotary movement of the winder arm causes the winding movement thereof to be stopped in known manner as soon as the number of turns of thread wound on the winder drum exceeds a predetermined value, and causes the winding movement to be started again as soon as this value is dropped below. This means that, immediately after the starting of the withdrawal of the thread from the drum, the rewinding of the drum commences and that it continues until the required length of thread is again stored on the drum.

With the thread-feed device of the invention, the two functions—winding of the drum and removal of thread from it—are thus separated from each other and nevertheless precisely measured pieces of thread are supplied by the thread-feed device although it was heretofore believed that this latter characteristic would only be satisfied if the two known functions were strictly coupled together and furthermore also synchronized with the drive of the loom.

The invention furthermore relates to a method of operating the said thread-feed device. It is characterized by determining how many turns of thread on the winder drum correspond to the length of thread required for a filling insertion on a loom, adjusting the device for controlling the rotary movement of the winder arm to a number greater than the required number n of turns, and so adjusting the control unit that upon the arrival of the first (n−1)th signal it gives off a second signal so that the thread gripper is activated between the (n−1)th and nth passes of the thread.

DESCRIPTION OF A PREFERRED EMBODIMENT

The above and other advantages of the thread-feed device of this invention and method of operation will become apparent from the following description and the drawing in which is shown a plan view of the thread feeding device with portions of it in partial cross-section, illustrating the thread wound on the drum and the controls for operating the thread feeding device.

The drawing shows a thread-feed device 1 which has a bushing-like supporting part 2, via which the thread-feed device 1 is fastened to the one side wall of a loom (not shown). On this same wall there is also mounted a supporting arm 3 on which a balloon-breaker ring 6 and a thread guide eye 7 are mounted via supports 4 and 5. In the bushing-like supporting part 2 of the thread-feed device 1 a shaft 8 is supported for rotation with the interposition of a number of ball bearings, not shown in detail. On its end which extends to the left (as seen in the drawing) from supporting part 1, the shaft bears a driven pinion 9. The pinion 9 can be driven, for instance, via a motor and a magnetic clutch. Motor and clutch have not been shown; the switch device which actuates the clutch is designated 10. A housing 11 is fastened on the shaft 8 and therefore is turnable relative to the stationary supporting part 2 and bears a winder arm 12 in the form of a tube.

A cylindrical hub part 13 is rotatably supported on the shaft 8 with the interposition of ball bearings 14 and is coupled with the supporting part 2 via a gearing (not shown in detail) within the housing 11 in such a manner that it remains stationary when the shaft 8 rotates. The tube forming the winder arm 12 opens into a central bore 15 positioned in the shaft 8, which bore can be noted in the left end of the drawing. The axis of the bore 15 forms the axis of rotation of the winder arm.

On the right-hand end of the shaft 8, as seen in the drawing, a winder drum 16 is supported overhung, adjoining the hub part 13. The winder drum 16 is formed by a pot-shaped housing which is fastened on its left, open end to a disk 17 borne by the hub part 13. In this way the winder drum 16 is secured against turning, i.e. it remains stationary while the shaft 8 and winder arm 12 rotate.

The winder drum 16 is provided at its rear end with a conical widening 18 in the plane defined by the free end of the rotating winder arm 12 and has, adjoining it towards its front end, a slightly conical or cylindrical portion 19. At its front end the winder drum 16 is closed by the balloon-breaker ring 6, a slot 20 sufficient for the passage of the filling thread S being present between the drum wall and the balloon breaker ring 6.

The filling thread S withdrawn from s supply spool (not shown) passes through the bore 15 and the winder arm 12 to the conical widening 18 of the winder drum 16. Upon a rotation of the winder arm 12 the filling thread S slides onto the cylindrical or slightly conical drum part 19 on which the individual turns of the thread are moved towards the balloon-breaker ring 6 upon continuous rotation of the winder arm 12. The removal of the stored filling thread is effected through the slot 20 between winder drum 16 and balloon-breaker ring 6 and through the thread guide eye 7 to the place of use, for instance to the insertion jet of a jet loom (not shown).

On the support arm 3 there are furthermore provided a first and a second photoelectric detection device or detection means or monitoring device A and B respectively, each consisting of a source of light 21 and 23 respectively, and of a photocell 22 and 24 respectively. The beam of light from the light sources 21 and 23 impinges obliquely on the winder drum 16 and is reflected by the reflective surface thereof onto the photocells 22 and 24 respectively. The sources of light 21 and 23 are connected by wires to a source of voltage; the photocell 22 is connected by wires 25 to the switch device or means 10; and the photocell 24 is connected by wires 26 to a control unit or means 27.

As soon as there have been wound on the winder drum 16 a number of turns of the filling thread S such that they cover the detection region of the first detection device A, the light path between source of light 21 and photocell 22 is interrupted. The photocell 22 produces a corresponding signal which passes to the switch device 10, whereupon the latter interrupts the drive of the winder arm 12. As soon as the region of detection of the first detection device A is again free of turns of thread as a result of the withdrawal of the filling thread from the winder drum 16, the device of the winder arm 12 is again connected and a new winding process commences. The position of the detection device A is so selected that the drive of the winder arm 12 is shut off only when the length of the filling thread S wound onto the winder drum 16 is greater than the width of weave and therefore greater than the length of filling thread required for an insertion.

While the first detection device A serves to control the rotary movement of the winder arm 12 as a function of the length of the supply of thread formed on the winder drum 16, the second detection device B serves to measure the length of thread withdrawn in each case from the winder drum 16 and to determine the moment when the length of thread required for a filling insertion has been withdrawn so that a thread gripper, arranged between thread-feed device and insertion jet of the loom, can be closed at precisely the right moment.

If the filling thread S is withdrawn overhead from the winder drum 16 this means that the piece of thread extending from the winder drum 16 to the thread guide eye 7 continuously travels around the wall of the drum. Each time that the said piece of thread intersects a specific point on the circumference of the drum, a length of thread corresponding to the circumference of the drum has been precisely withdrawn. This specific point is formed by the region of detection of the second detection device B which, upon each pass of thread, produces a signal which indicates that a piece of thread of the length of the circumference of the drum has just been withdrawn. One now determines how many of such pieces of thread are necessary for a filling insertion and sets a threshold-value detector of the control unit 27 to the corresponding number of signals from the second detection device B. The signals of the second detector device B are counted in the control unit 27 and when the threshold value is reached the thread gripper is closed by the control unit 27. The thread gripper is preferably electromagnetically actuated; since a certain period of time passes from the time that it is actuated until it has been closed, the control unit 27 is preferably so adjusted that the control signal for the thread gripper is produced one signal before the threshold value is reached. If the response time of the thread gripper is shorter than the time interval between two successive signals of the second detection device B, this can be compensated for by a corresponding signal-delay member.

As shown in the drawing, an electromagnetic thread gripper means 28 connected to the control unit 27 is arranged on the balloon-breaker ring 6. This gripper has a bolt 29 which can be electromagnetically actuated and lowered against the circumference of the winder drum 16. The winder drum is provided with a bore 30 in the region of the bolt 29 so that the bolt 29, upon the lowering thereof, can penetrate into the circumference of the drum and form a stop acting as thread gripper for the filling thread S withdrawn.

The development and arrangement of the thread gripper 28 shown in the drawing is particularly advantageous since it is insensitive to variations in the response and/or release time. If the length of filling thread to be inserted corresponds to n signals of the second detection device B then, as already stated, the control unit is adjusted in such a manner that it gives off the control signal for the actuating of the thread gripper 28 after $n-1$ signals of the second detection device B. Now the bolt 29 is lowered, the only important thing being that it is also in lowered position upon the next thread pass. The exact time of this, on the other hand, is unimportant.

The thread-feed device shown is to be understood to be merely an example, since the second detection device B can be installed on practically all commercial thread-feed devices with stationary winder drum, overhead withdrawal and first detection device. Thus there is a large amount of leeway for the arrangement of second detection device and thread gripper. It is essential for the second detection device that it be arranged behind the first detection device in the direction of travel of the filling thread S and in the region of the withdrawal end of the winder drum 16. It can, of course also be arranged just behind said end and be developed as a transparent and not as a reflection light barrier. In similar fashion, the thread gripper 28 need not be borne by the balloon-breaker ring 6; it could also be arranged on the supporting arm 3 or on a special support. The arrangement of the thread gripper on the loom itself is also entirely possible. Similarly, the thread gripper could also be arranged within the winder drum 16, in which case the bolt 29 would have to penetrate to the outside of the wall of the drum for its gripping position.

If one starts from an ordinary diameter of the winder drum of 10 cm, then each signal of the second detection device corresponds to a withdrawn length of thread of about 30 cm. Ordinarily, the gradation of the weaving widths is substantially finer than in steps of 30 cm. In order to permit also of a finer gradation of the lengths of filling thread supplied by the thread-feed device 5, one can either use a winder drum 16 of adjustable circumference (see West German OS No. 29 20 629) or arrange, uniformly distributed over the circumference of the winder drum a plurality of second detection devices B and associated thread grippers 28, in which case detection device and thread gripper can be combined in each case to form a structural unit. If one, for instance, provides ten such units, then the length of the measured filling thread can be gradated in steps of 3 cm. Of course, the first detection device A is also adjustable in the direction of the axis of the winder drum 16 for adaptation to different weaving widths.

From what has been stated above it follows that, with the thread-feed device 1 described, the two functions of storage and removal of the stored thread are entirely separate from each other. Storing takes place only when the amount of thread stored is less than the length required for a filling insertion, and withdrawal takes place when the insertion jet actually inserts the thread. In this connection, the thread-feed device supplies the filling thread to the jet in the length precisely required. Due to these properties, the thread-feed device described is particularly well suited for use on jet looms, both for single-color and for multi-color filling insertion. In the former case, the winder arm 12 would operate more or less continuously.

By the development of the thread gripper as stop bolt on the wall of the winder drum, which bolt is brought after each next-to-the-last thread pass into the position in which it blocks the withdrawal of thread, the filling thread is blocked always for the same inserted length regardless of the speed with which it passes through the shed during the withdrawal of the last part corresponding to one drum circumference.

In operation, the thread-feed device comprising the stationary winder drum 16 stores a supply of thread which can be wound-on by means of a rotatable winder arm and removed overhead from the winder drum controlled by device A which automatically controls the rotary movement of the winder arm as a function of the length of the supply of thread formed. Within the region of the withdrawal end of the winder drum 16, the monitoring device B gives off a first signal to a control unit 27 upon each pass of the thread S through its monitoring region during the withdrawal of the thread. The control unit 27 counts the first signals and, as soon as their number reaches a predetermined adjustable value which corresponds to the desired, required length of thread, there is given off a second signal by which the thread gripper 28 is actuated so that the thread-feed device delivers precisely measured lengths of thread, such as required for instance for the filling insertion on jet looms.

The operation of the thread-feed device may be accomplished by ascertaining how many thread turns on the winder drum 16 correspond to the length of thread required for a filling insertion on a loom, adjusting the device A for the control of the rotary movement of the winder arm 12 to a number which is greater than the required number n of turns, and so adjusting the control unit 27 that upon the arrival of the $(n-1)$th first signal it gives off a second signal so that the thread gripper 28 is activated between the $(n-1)$th and nth pass of the thread S.

Also operating the thread-feed device when using a plurality of m monitoring devices B and m thread grippers 28, the control unit 27 may be adjusted in such a manner that upon the arrival of the $m(n-1)$th first signal it gives off the second signal and does so to that one of the thread grippers at which the thread S upon its following pass just exceeds the required length of thread.

Although the invention is described in detail for the purpose of illustration, it is to be understood that such detail is solely for that purpose and that variations can be made therein by those skilled in the art without departing from the spirit and scope of the invention except as it may be limited by the claims.

What is claimed is:

1. A thread-feed device for textile machines having a stationary winder drum onto which a thread fed from a stationary winding bobbin can be wound by means of a rotatable winder arm for the formation of a thread supply and the thread supply formed can be withdrawn on top, and having a first detection device for automatically controlling the rotary movement of the winder arm as a function of the length of the supply of thread formed, characterized by:

a. a second detection device arranged in the region of the withdrawal end of the winder drum to give a first signal upon each passage of the thread during its withdrawal through its monitoring region, b. a control unit arranged behind the second detection device for the counting of the first signals and the giving off of a second signal as soon as the number of first signals reaches a predetermined adjustable value corresponding to the required length of thread, and c. a thread gripper means which is operably connected to the control unit and can be controlled by the second signal.

2. The thread-feed device according to claim 1 characterized by the fact that the second detection device is formed by a photoelectric detection device.

3. A thread-feed device for textile machines having a stationary winder drum onto which a thread fed from a stationary winding bobbin can be wound by means of a rotatable winder arm for the formation of a thread supply and the thread supply formed can be withdrawn on top, and having a first detection device for automatically controlling the rotary movement of the winder arm as a function of the length of the supply of thread formed, characterized by:

a. a second detection device arranged in the region of the withdrawal end of the winder drum to give a first signal upon each passage of the thread during its withdrawal through its monitoring region, b. a control unit arranged behind the second detection device for the counting of the first signals and the giving off of a second signal as soon as the number of first signals reaches a predetermined adjustable value corresponding to the required length of thread, c. a thread gripper means which is operably connected to the control unit and can be controlled by the second signal, the thread gripper means arranged fixed in space in the region of the withdrawal end of the winder drum and having an electromagnetically actuatable bolt which is movable against the cylindrical surface of the winder drum and in its active position forms a stop for the filling thread withdrawn, the said thread gripper means being arranged outside the winder drum and the winder drum is provided on its circumference with a recess for the entrance of the end of the bolt into the wall of the winder drum.

4. The thread-feed device according to claim 3 characterized by the fact that a plurality of second detection devices and associated thread gripper means is provided.

5. The thread-feed device according to claim 4 characterized by the fact that the second detection devices and thread gripper means are arranged distributed uniformly along a circumferential circle on the wall of the winder drum.

6. The thread-feed device according to claim 5 characterized by the fact that the number of second detection devices and thread gripper means is between 3 and 10 each.

7. The thread-feed device according to claim 6 characterized by the fact that the second detection devices and thread gripper means are supported by a ring-shaped carrier which surrounds the winder drum.

8. The thread-feed device according to claim 7 characterized by the fact that the ring-shaped carrier forms a balloon-breaker ring.

9. The thread-feed device according to claim 3 characterized by the fact that the second detection device is formed by a photoelectric detection device.

10. The thread-feed device according to claim 9 characterized by the fact that a plurality of second detection devices and associated thread gripper means is provided.

11. The thread-feed device according to claim 10 characterized by the fact that the second detection devices and thread gripper means are arranged distributed uniformly along a circumferential circle on the wall of the winder drum.

12. The thread-feed device according to claim 11 characterized by the face that the number of second detection devices and thread gripper means is between 3 and 10 each.

13. The thread-feed device according to claim 12 characterized by the fact that the second detection devices and thread gripper means are supported by a ring-shaped carrier which surrounds the winder drum.

14. The thread-feed device according to claim 13 characterized by the fact that the ring-shaped carrier forms a balloon-breaker ring.

15. A method of operating a thread-feed device for textile machines having a stationry winder drum onto which a thread fed from a stationary winding bobbin can be wound by means of a rotatable winder arm for the formation of a thread supply and the thread supply formed can be withdrawn on top, and having a first detection device for automatically controlling the rotary movement of the winder arm as a function of the length of the supply of thread formed, characterized by:

a. a second detection device arranged in the region of the withdrawal end of the winder drum to give a first signal upon each passage of the thread during its withdrawal through its monitoring region, b. a control unit arranged behind the second detection device for the counting of the first signals and the giving off of a second signal as soon as the number of first signals reaches a predetermined adjustable value corresponding to the required length of thread, and c. a thread gripper means which is operably connected to the control unit and can be controlled by the second signal;

said device being operated to determine how many thread turns on the winder drum correspond to the length of thread required for a filling insertion on a loom by adjusting the first detection device for the control of the rotary movement of the winder arm to a number which is greater than the required number n of the turns, and so adjusting the control unit that upon the arrival of the $(n-1)$th first signal it gives off a second signal so that the thread gripper means is activated between the (n−1)th and the nth pass of the thread.

16. The method of operating the thread-feed device defined by claim 15 using a plurality of m second detection devices and m thread gripper means, the control unit adjusted in such a manner that upon the arrival of the m(n−1)th first signal it gives off the second signal and does so to that one of the thread grippers at which the thread upon its following pass just exceeds the required length of thread.

* * * * *